US009228263B1

(12) United States Patent
Bhargava et al.

(10) Patent No.: US 9,228,263 B1
(45) Date of Patent: Jan. 5, 2016

(54) CHEMICAL CONVERSION COATING FOR PROTECTING MAGNESIUM ALLOYS FROM CORROSION

(71) Applicant: NEI Corporation, Piscataway, NJ (US)

(72) Inventors: Gaurang Bhargava, Monmouth Junction, NJ (US); Fred M. Allen, Princeton Junction, NJ (US); Ganesh Skandan, Easton, PA (US); Peter Hornish, Stewartsville, NJ (US); Mohit Jain, East Brunswick, NJ (US)

(73) Assignee: NEI Corporation, Piscataway, NJ (US)

( * ) Notice: Subject to any disclaimer, the term of this patent is extended or adjusted under 35 U.S.C. 154(b) by 363 days.

(21) Appl. No.: 13/656,963

(22) Filed: Oct. 22, 2012

(51) Int. Cl.
*C23C 22/57* (2006.01)
*C23C 22/40* (2006.01)

(52) U.S. Cl.
CPC ..... *C23C 22/57* (2013.01); *C23C 22/40* (2013.01)

(58) Field of Classification Search
CPC ..... C23C 22/40; C23C 22/57
USPC ..... 148/275
See application file for complete search history.

(56) References Cited

U.S. PATENT DOCUMENTS

| | | | |
|---|---|---|---|
| 4,828,615 | A | 5/1989 | Cape |
| 6,887,320 | B2 | 5/2005 | Briles |
| 7,135,075 | B2 | 11/2006 | Buchheit |
| 7,964,030 | B1 | 6/2011 | Nakatsugawa |
| 2003/0150526 | A1 | 8/2003 | Bengston |
| 2004/0216637 | A1 | 11/2004 | Buchheit |
| 2008/0254315 | A1 | 10/2008 | Sato |
| 2011/0041958 | A1 | 2/2011 | Sato |

*Primary Examiner* — Lois Zheng
(74) *Attorney, Agent, or Firm* — William L. Botjer

(57) ABSTRACT

A chromate-free, self-healing conversion coating solution for magnesium alloy substrates, composed of 10-20 wt. % $Mg(NO_3)_2.6H_2O$, 1-5 wt. % $Al(NO_3)_3.9H_2O$, and less than 1 wt. % of $[V_{10}O_{28}]^{6-}$ or $VO_3^-$ dissolved in water. The corrosion resistance offered by the resulting coating is in several hundreds of hours in salt-spray testing. This prolonged corrosion protection is attributed to the creation of a unique structure and morphology of the conversion coating that serves as a barrier coating with self-healing properties. Hydroxoaluminates form the backbone of the barrier protection offered while the magnesium hydroxide domains facilitate the "slow release" of vanadium compounds as self-healing moieties to defect sites, thus providing active corrosion protection.

6 Claims, 13 Drawing Sheets

(a)

(b)

(a) (b)

(a) (b)

(a)

(b)

(b)

(a)

(c)

CHEMICAL CONVERSION COATING FOR PROTECTING MAGNESIUM ALLOYS FROM CORROSION

STATEMENT OF GOVERNMENT SUPPORT OF INVENTION

The work leading to the present application was done as part of Department of Energy Grant Number: DE-FG02-08ER85204, the government has certain rights in the invention.

BACKGROUND OF THE INVENTION

This invention relates to a novel chromate-free, self-healing conversion coating that provides significant corrosion resistance to magnesium alloys, along with strong adhesion with an overlaying paint layer (primer). The coating liquid is a waterborne formulation, that when applied to magnesium alloy panels by immersion, leads to less corrosion than other chromate and non-chromate industry standards. Based on results for treated-only samples, this new coating offers corrosion protection similar to a state-of-the-art chromate-free anodized coating.

Many methods have been used to protect magnesium alloys by inhibiting corrosion or slowing down the reaction mechanisms, including use of conversion coatings, anodizing, electroplating and addition of corrosion inhibitors. Conversion coatings are among the more cost-effective, and therefore, widely used methods to provide a barrier between the metal and its surrounding environment. It also serves as a tie-layer to improve adhesion between the metal substrate and subsequent paint (primer and topcoat) layers. The most popular and reliable conversion coating for magnesium is a conversion coating containing hexavalent chromium ($Cr^{6+}$), also known as hex-chrome or chromate. However, the use of $Cr^{6+}$ has been drastically curtailed in recent years as it has been found to be carcinogenic. Due to environmental concerns, recent efforts are concentrated on making chromate-free conversion coatings.

Different groups have used Vanadium-containing compounds, in one form or another, as an alternative to hexavalent chromium. Some of the relevant patents are: U.S. Pat. No. 4,828,615 is directed to the use of pentavalent vanadium, subsequent to a conversion coating. US Patent application No. 2003/0150526 A1 relates to a conversion coating comprising a source of vanadate ions, a material comprising phosphorus, source of nitrate ions, preferably with borate ions and fluoride ions. Patent application US 2004/0216637 A1 and U.S. Pat. No. 7,135,075, discuss an inorganic corrosion resistant coating with self-healing properties comprising a vanadate salt as a film forming agent, a supplemental soluble metal anion and a substrate activator. U.S. Pat. No. 6,887,320 mentions a process for applying a chromate-free, corrosion resistant coating comprising the steps of degreasing, cleaning, deoxidizing and immersing in a solution containing phosphate and fluoride ions with sodium tungstate and sodium vanadate as an active corrosion inhibitor. US Patent Applications 2008/0254315 A1 and US 2011/0041958, relate to an acidic chromium free solution for treating a metal surface comprising a vanadium cation and/or a vanadyl cation, an anion from an organic acid and an anion selected from the group consisting of oxoacids of nitrogen, sulfur, phosphorus, boron and chlorine. U.S. Pat. No. 7,964,030 B1 describes a vanadate solution for conversion treating a magnesium alloy containing metavanadate ion, and a polyhydroxylated aromatic compound in water.

As mentioned above, the use of vanadium ($V^{4+}$ or $V^{5+}$) in the presence of nitrate ions in a certain concentration range has been claimed. However, these coating formulations also require either, an activator or a corrosion inhibitor and/or supplemental ions to further promote film formation. For example, US Patent application No. 2003/0150526 A1 relates to a conversion coating comprising a source of vanadate ions, a material comprising phosphorus, source of nitrate ions, preferably with borate ions and fluoride ions. Phosphorus-based treatment results in a hard layer of insoluble phosphate, which is contiguous and highly adherent to the underlying metal. In contrast to all the above described coating inventions, the present invention does not require any supplement ions for the formation and stability of the conversion coating.

The chromate-free, self-healing conversion coating of the present invention provides an order of magnitude better corrosion resistance compared to previously reported conversion coatings. The superior protection of the conversion coating is attributed to the creation of a unique structure and morphology that serves as a barrier coating that simultaneously has self-healing properties. A hydroxoaluminate complex forms the backbone of the barrier coating, while the magnesium hydroxide domains facilitate the "slow release" of vanadium moieties to the defect sites, thus providing active corrosion protection. This synergistic performance using environmentally friendly chemicals leads to the enhanced corrosion protection.

SUMMARY OF THE INVENTION

In contrast to state of the art coating technologies, the present invention is a microns-thick chemical conversion coating that imparts corrosion resistance via a self-healing mechanism, provides excellent adhesion with the overlying primer layer, and offers barrier protection. Accelerated corrosion testing has demonstrated the superior corrosion resistance of the coating of the present invention. In addition, the coating comprises of a mixture of hydroxoaluminates and magnesium hydroxide domains which encapsulate vanadium moieties. This structure facilitates a "slow release" of the self-healing species to the defect sites. As a result, the coating shows active corrosion protection.

Formation of a chemical conversion coating on a metallic substrate involves the dissolution of the metal, which causes a change of the chemical environment near the metal surface, such as local pH and concentration of solution species. Hence, an appropriate source mixture of nitrate ions was chosen to decrease the pH of the coating solution. This led to surface etching, resulting in the availability of $Mg^{2+}$ ions needed for the formation of the conversion coating. Additionally, $Al^{3+}$ ions were provided externally, which imparted the "barrier layer" characteristics to the conversion layer. The blend of nitrate ions (from water soluble salts), metal ions and vanadium species imparting the self-healing characteristic resulted in the conversion coating whose performance exceeded that of chromate conversion coating and matched the degree of protection provided by non-chromate anodized coatings.

Specifically, the current invention is directed to a chromium free, self-healing conversion coating composed of the following ingredients:

- a source of aluminum ions (e.g., aluminum nitrate) resulting in hydroxoaluminate rich backbone, to act as a barrier layer;

a source of magnesium ions (e.g., magnesium nitrate) resulting in an magnesium hydroxide domains that act as a pH stabilizer and facilitate the "slow release" of vanadium moieties, and vanadate salts to provide decavanadate ions $[V_{10}O_{28}]^{6-}$, to provide self-healing characteristic to the coating.

The combination of the two nitrates in solution etches the surface of the magnesium substrate so that it becomes "ready" to receive the conversion layer. The nitrate ions undergo the following reduction reaction (as it is a common oxidizing agent):

$$NO_3^- + 2H^+ + 2e^- \rightarrow NO_2^- + H_2O$$

This reduction of the nitrate ions increases the local pH of the solution leading to precipitation of hydroxoaluminates on the alloy surface. Hence, the conversion coating formed is a mixture of hydroxoaluminates and magnesium hydroxides in conjunction with the self-healing component (Vanadium).

BRIEF DESCRIPTION OF THE DRAWINGS

For a better understanding of the invention, reference is made to the following drawings which are to be taken in conjunction with the detailed description to follow.

DESCRIPTION OF THE PREFERRED EMBODIMENTS

Overview

The present invention is directed to a non-chromate conversion coating for magnesium alloy substrates including the following ingredients: a) a source of aluminum ions resulting in hydroxoaluminate rich backbone as a barrier layer; b) vanadate salts to provide decavanadate ions $[V_{10}O_{28}]^{6-}$ to provide a self-healing nature to the pretreatment and c) a source of magnesium ions to act as a pH stabilizer and to facilitate slow release of the vanadium species.

The salts providing aluminum ions include aluminum based inorganic and organic water soluble salts including but not limited to aluminum nitrate, aluminum chloride, aluminum sulfate, aluminum perchlorate, and aluminum acetate. The salts providing magnesium ions include magnesium based inorganic and organic water soluble salts including magnesium nitrate, magnesium chloride, magnesium sulfate, magnesium chlorate, and magnesium acetate. Vanadium salts with oxidation state of +5 that can subsequently form decavanadate ions in solution include, but are not limited to sodium metavanadate and ammonium metavanadate.

A typical coating solution formulation is comprised of 10-20 wt. % $Mg(NO_3)_2.6H_2O$, 1-5 wt. % $Al(NO_3)_3.9H_2O$, and less than 1 wt. % of $[V_{10}O_{28}]^{6-}$ dissolved in water, preferably DI (deionized) water. Such coatings may be obtained by mixing the following solid components (i.e., powders) by weight: $40\% < Mg(NO_3)_2.6H_2O < 80\%$; $5\% < Al(NO_3)_3.9H_2O < 20\%$ and $(NH_4)_6V_{10}O_{28}.6H_2O < 5\%$ with an amount of water (preferably DI water) adjusted in such a way that: the solution is not so thick that it cannot coat the surface and that the solution is not so dilute that it does not form a comprehensive conversion coating.

Figure 1:
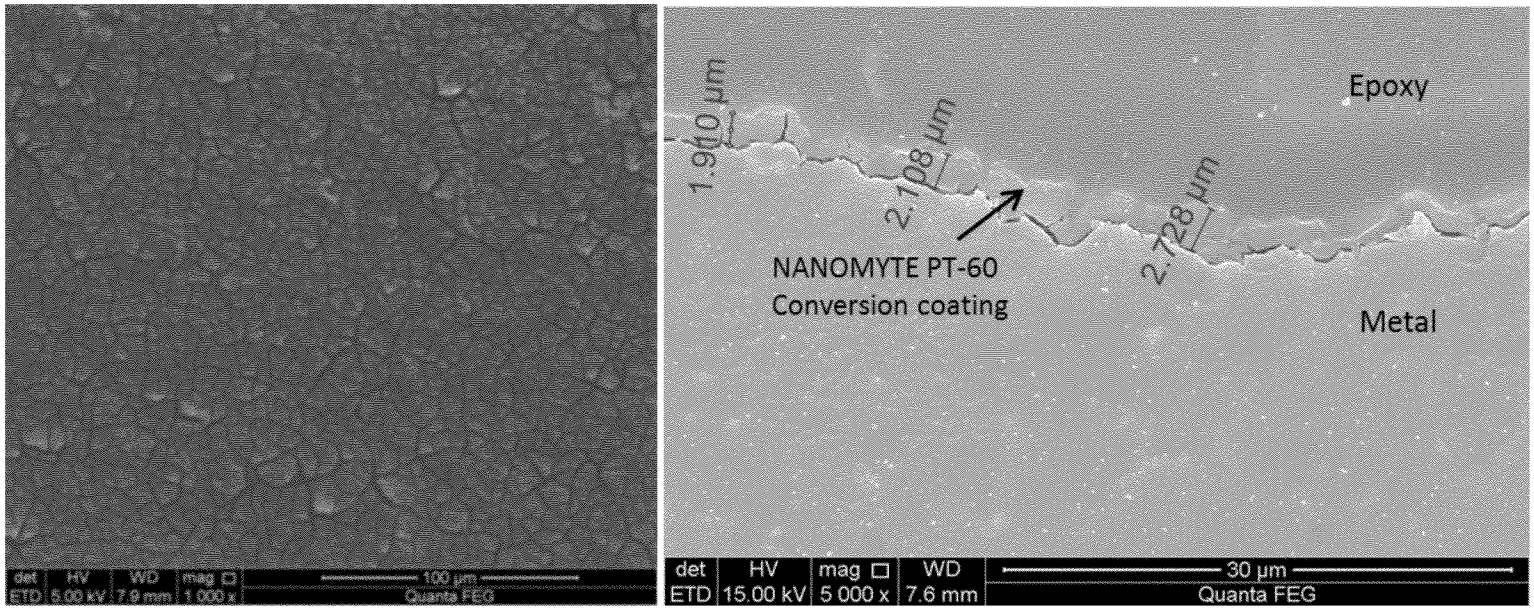
FIG. 1: SEM image of AZ91D Magnesium alloy panel that was acid etched for de-oxidation, and then immersed in the present coating solution for 10 minutes at ambient conditions. The panels, which were initially dull gray in color, were coated with a bright yellow-green layer, approximately 2-3 μm thick.
Figure 3:
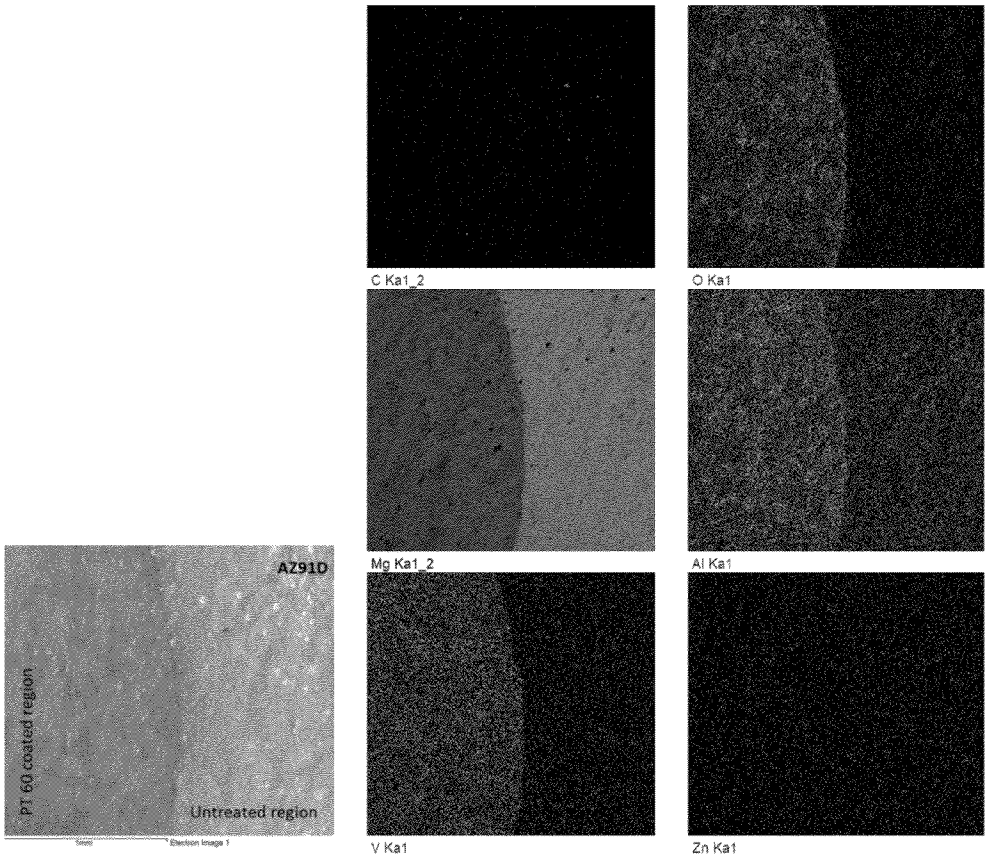
FIG. 3: (a) SEM image of untreated and coated region of AZ91D Magnesium alloy, coated with the present composition; (b) EDS mapping of the untreated and coated regions. The maps indicate that the coated region exhibits greater signals of aluminum, vanadium and oxygen, compared to the untreated region. The magnesium signal was weaker than the untreated region.
Figure 4:
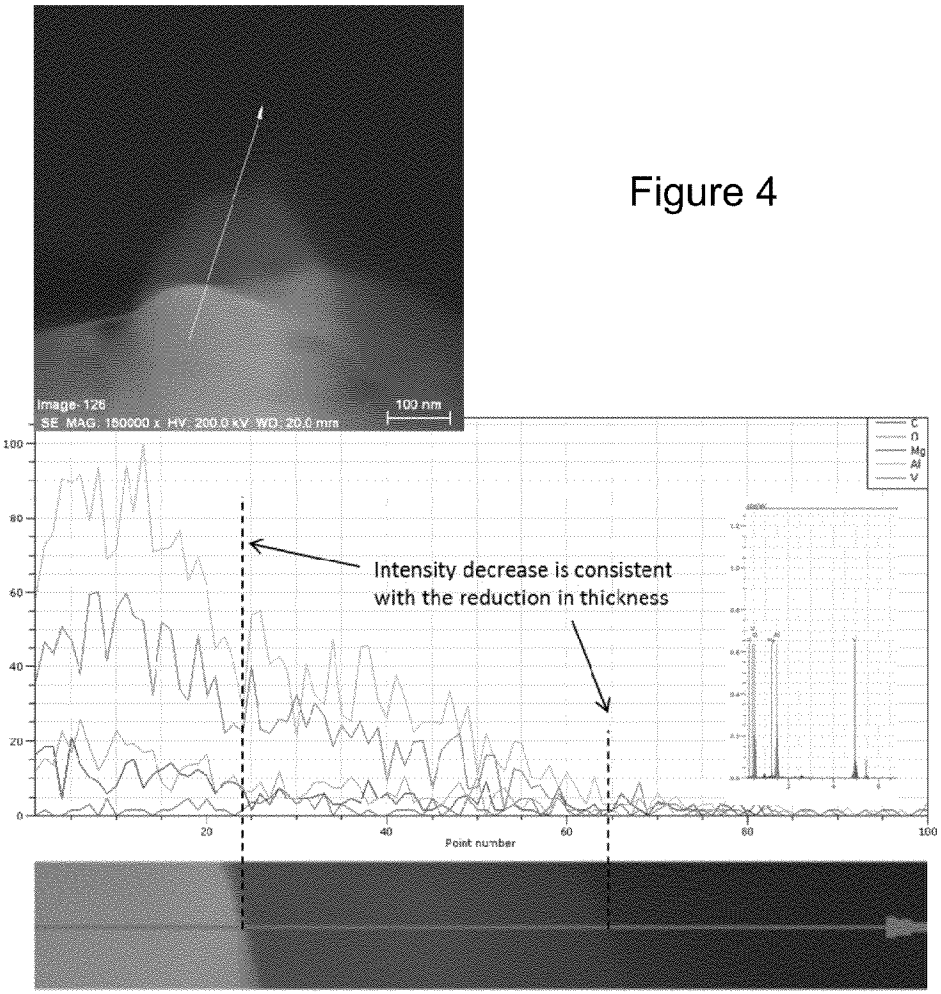
FIG. 4: STEM image of the region coated with the present coating composition. Elemental line profile along a surface feature suggests that the conversion coating has higher concentration of aluminum, vanadium than magnesium. This is consistent with the EDS elemental maps acquired during SEM.

A Preferable concentration of $Mg(NO_3)_2.6H_2O$ is 19.30%, that of $Al(NO_3)_3.9H_2O$ is 4.71%, that of $[V_{10}O_{28}]^{6-}$ is 0.60%, with 75.39% of DI water. The pH of the solution is less than 3, in part due to the hydrolysis of $Al^{3+}$ and $Mg^{2+}$ ions. A typical coating process includes the following steps: 1) acid etch (pickle) using a mixture of nitrates and organic acids, and 2) pretreatment in the formulated bath at room temperature. Acid etching of the panels was found to be necessary to deoxidize the surface of the magnesium alloy. It required only 30 seconds to 3 minutes of immersion in the acid bath to deoxidize the chosen magnesium alloy. The conversion coating process usually involves the immersion of the cleaned panels in the formulated bath for 1-10 minutes at room temperature, depending on the chosen magnesium alloy. The panels that were initially dull gray in color were coated with a bright yellow-green layer approximately 2-3 μm thick as shown in FIG. 1. The coating chemistry was subsequently verified by elemental mapping using SEM-EDX, and STEM (FIGS. 3 and 4). A defect-free army green coating can thus be formed onto Mg AZ91D alloy. Those skilled in the art will know that a similar coating composition and a similar coating method as described above can be used to coat magnesium alloys of different compositions than AZ91D.

Figure 2:
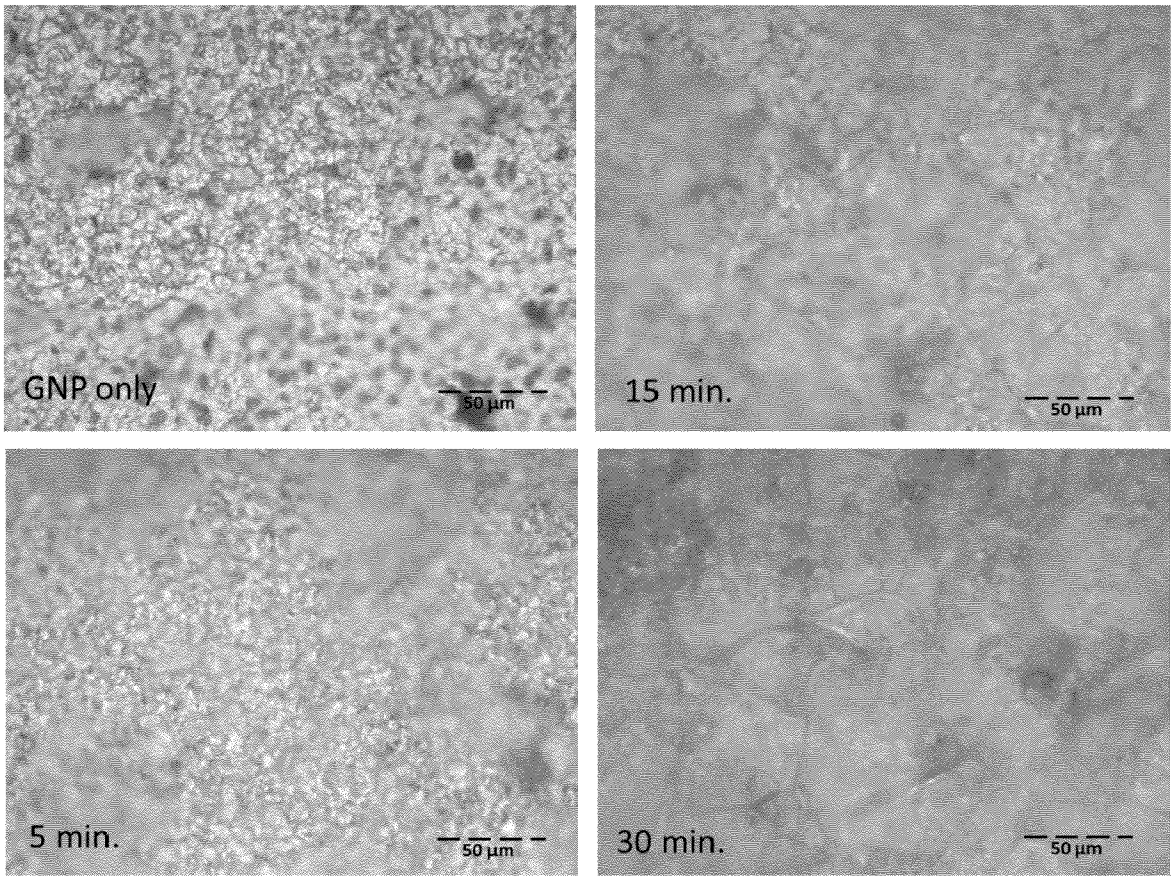
FIG. 2: Optical images of Mg AZ91D alloy (a) acid etched using a mixture of Glycolic acid and Sodium nitrate (GNP), and subsequently coated with (b) the present composition for 5 minutes, (c) for 15 minutes and (d) for 30 minutes. It can be seen that the present composition produces a two-phase conversion layer (granular inner layer with an amorphous layer on top) with increasing immersion time.

Optical microscopy of Mg AZ91D panels as shown in FIG. 2, suggests the emergence of a two-phase morphology with increasing immersion time in the coating solution. After 5 minutes or more, a second amorphous phase begins to form. The formation and functioning of the conversion coating is described as follows:

At pH <3, the cationic acid $[Al(H_2O)_6]^{3+}$ is stable in water. At higher pH values, multinuclear hydroxoaluminates are formed (e.g., at pH 3-4, binuclear complex ions $[Al_2(OH)_2(H_2O)_8]^{4+}$ are formed via $[Al(OH)(H_2O)_5]^{2+}$ ions accompanied by the loss of $H_2O$ molecules) [Holleman-Wiberg Inorganic Chemistry, Ed. Nils Wiberg. Berlin, N.Y. Academic Press, 2001, pp. 1016-1017]. Hence, when the aluminum ions in the coating solution come in contact with the basic Mg AZ91D alloy surface, hydroxoaluminates formation takes place. Similarly, magnesium hydroxide domains are formed when the $Mg^{2+}$ ions in solution come in contact with the basic Mg AZ91D alloy surface [T. Fujino and T. Matzuda, "Synthetic Process of Environmentally-Friendly $TiO_2$ coating on Magnesium by Chemical Conversion Treatment", Materials Transactions, Vol. 47, No. 9 (2006), pp. 2335-2340]. Magnesium hydroxide formation on an alloy surface would consist of an array of $OH^-$ ions in which alternate layers of octahedral holes are occupied by $Mg^{2+}$ ions [Holleman-Wiberg Inorganic Chemistry, Ed. Nils Wiberg. Berlin, N.Y. Academic Press, 2001, pp. 1058-1059]. Thus there is a layered structure of . . . HO—$Mg^{2+}$OH—OH—$Mg^{2+}$OH– . . . which can easily be cleaved between similarly charged $OH^-$ layers.

Figure 5:
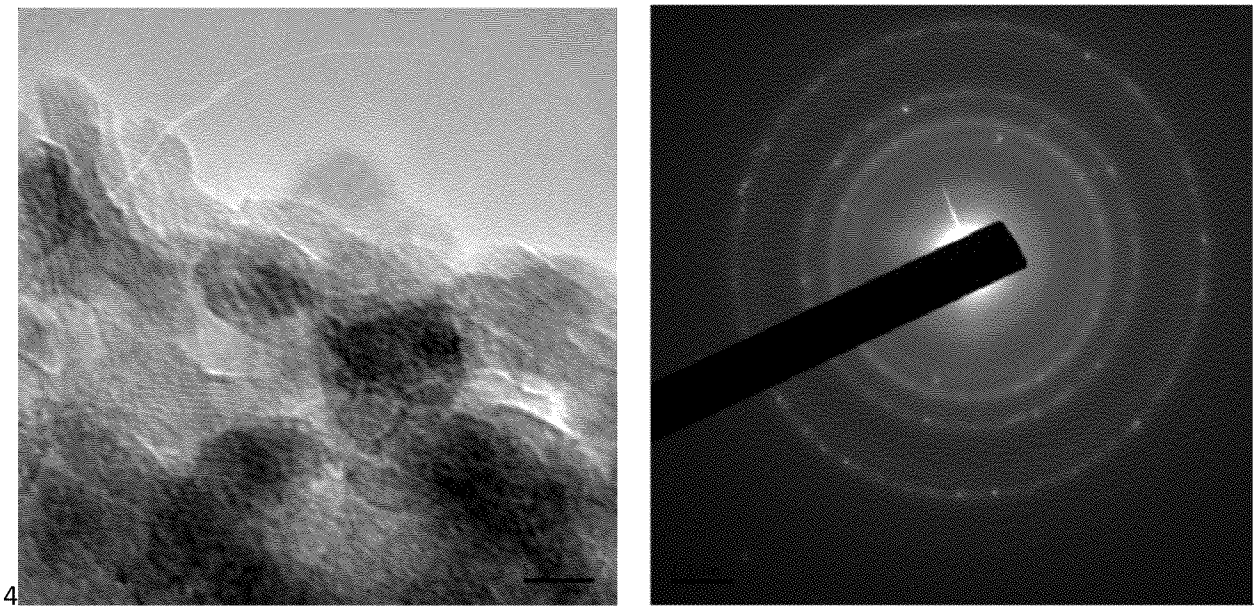
FIG. 5: (a) TEM image showing small crystallographic domains in the conversion coating. As observed, the domain size is in the range of 5 to 50 nm. (b) Diffused diffraction pattern supports the TEM data, indicating the amorphous nature of the coating with some crystallinity associated with the structure.

Under conditions outlined in the present invention, both the phenomena occur simultaneously to form a conversion coating. The coating consists of a heterogeneous mixture of domains of the multinuclear hydroxoaluminates and magnesium hydroxide. The vanadium ions in the form of vanadates or other moieties are encapsulated within these domains. As seen in FIG. 5(*a*), the domain size is in the range of 5 to 50 nm.

According to the solubility product values [Holleman-Wiberg Inorganic Chemistry, Ed. Nils Wiberg. Berlin, N.Y. Academic Press, 2001]:

$$K_{sp}(Al(OH)_3)=1.3\times10^{-33} \text{ at } 25^\circ \text{ C.}$$

$$K_{sp}(Mg(OH)_2)=5.61\times10^{-12} \text{ at } 25^\circ \text{ C.}$$

$$K_{sp}(Al(OH)_3)<Ksp(Mg(OH)_2)$$

Since Al has a greater tendency of making a hydroxide complex, magnesium ions dissolve slowly facilitating a "slow release" of Vanadium moieties providing self-healing properties.

An SEM image of the coating of the present invention shows comprehensive coverage of the surface of the substrate. Cross-sectional examination shows that the conversion coating is 2-3 μm in thickness with a 10 minute immersion time in the coating bath (FIG. 1). In another study, a thinner conversion layer was allowed to be formed with an immersion time of 10 seconds. The SEM image of the untreated and coated regions is shown in FIG. 3. EDX elemental mapping of the same region indicates that the coated region shows higher intensity of Al, V and O signal compared to the untreated region. The data supports the formation of compounds containing aluminum, vanadium and oxygen.

Figure 6:
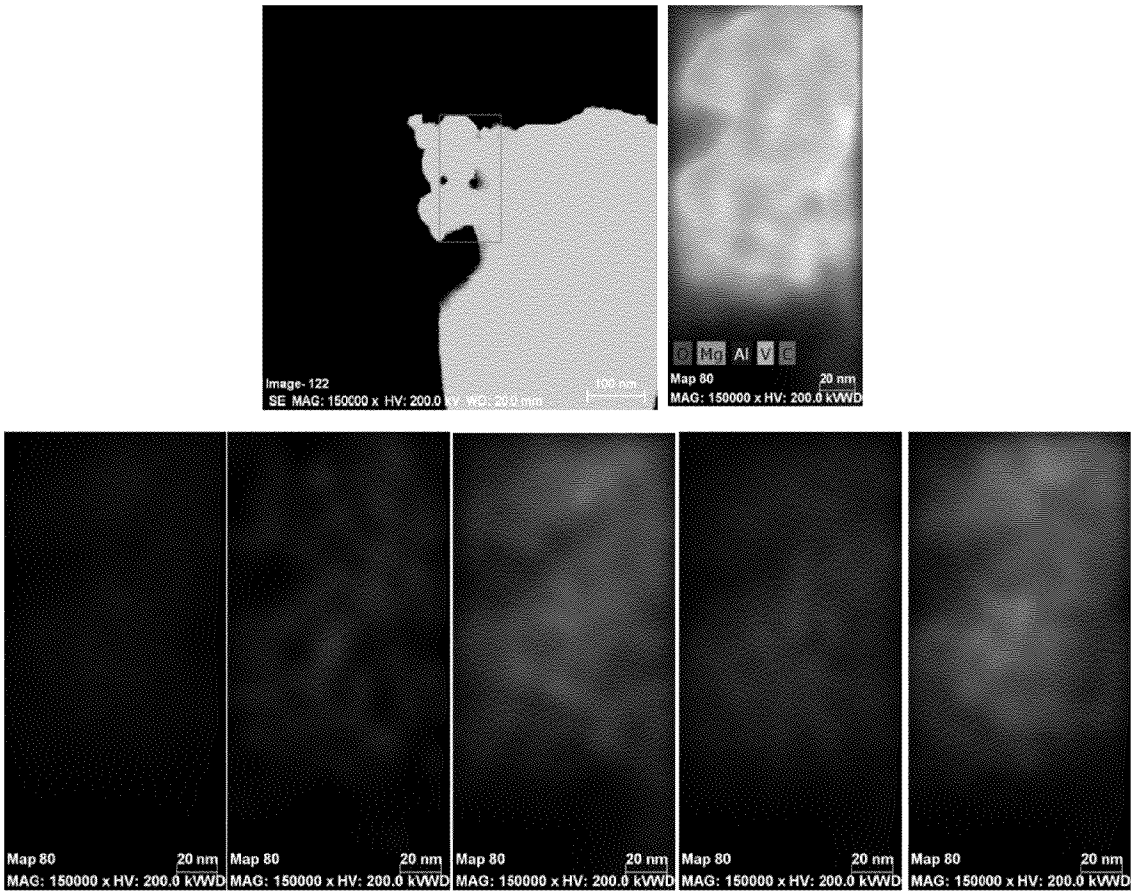
FIG. 6: Elemental mapping in STEM mode suggests that the present conversion coating is a heterogeneous mixture of aluminum, vanadium and magnesium containing compounds.

EDX line profiling was carried out using Scanning Transmission Electron Microscopy (STEM). Elemental mapping along a line suggests that the conversion coating has a relatively higher concentration of aluminum than magnesium, indicating that the conversion coating in the present invention has more hydroxoaluminates than magnesium hydroxides. This is shown in FIG. 4. Electron diffraction pattern shown in FIG. 5(*b*) and high resolution Transmission Electron Microscopy (TEM) image of FIG. 5(*a*) suggest that the conversion layer is mostly amorphous with some degree of crystallinity associated with it (the conversion coating has partial order with a distribution of small crystallographic domains). In addition, elemental mapping of the present coating (STEM mode) as shown in FIG. 6 suggest that the present conversion coating is a heterogeneous mixture of hydroxoaluminates, vanadium moieties and magnesium hydroxide domains.

Once the coatability of the conversion coating was established, the next step was to expose the coated panels to the elements. A standard ASTM B117 salt spray test was used to test the performance of this new chromate free conversion coating versus the chosen standards. The corrosion resistance and self-healing capability of the present conversion coating was examined by the properties of scribed panels, both unprimed and primed, which were coated with the coating of the present invention, and compared to bare (untreated) and chromate treated Mg AZ91D standards. When applied to a properly prepared metal surface, the present coating is expected to function as a pretreatment that can provide both barrier protection (reducing the corrosion rate), as well as adhesion promotion to improve the tenacity of overlying paint layers.

Figure 7:
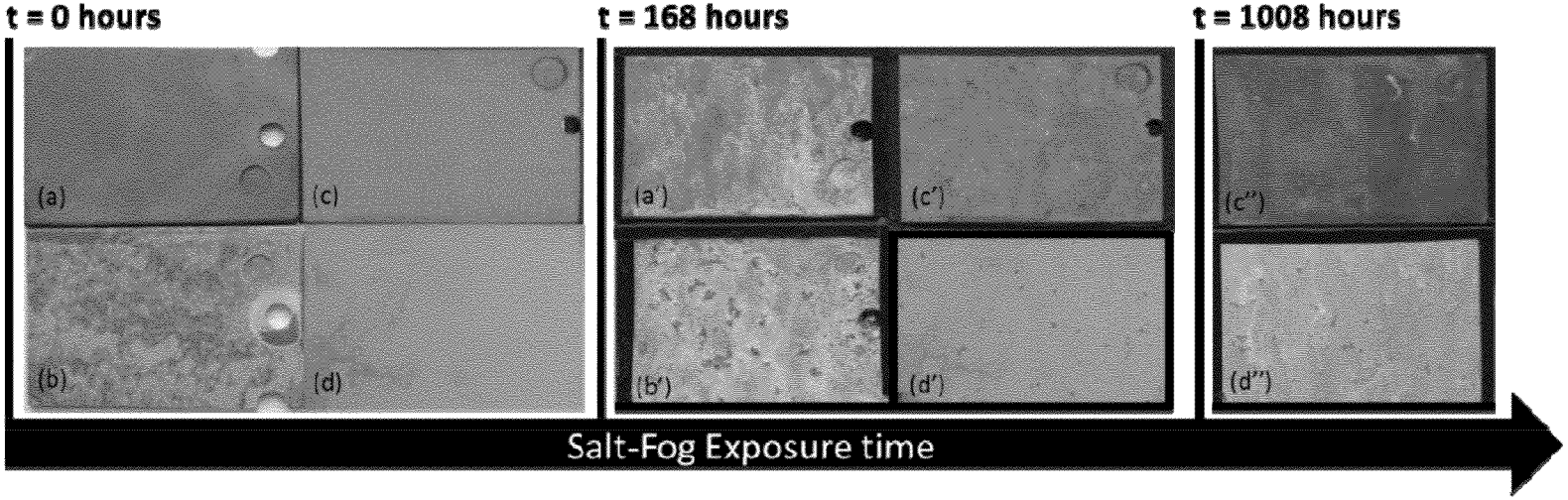
FIG. 7: 2"×3" panels of Mg AZ91D alloy coated with (a, a') chromate conversion coating, (b, b') chromate anodized coating, (c, c') the coating of the present invention and (d, d') chromate-free anodized coating; before and after 168 hours (1 week) of salt-fog exposure, respectively. Additionally, (c") the coating of the present invention and (d") chromate-free anodized coating show comparable protection even after 1008 hours (6 weeks) of salt-fog exposure.

The photographs in FIG. 7 compare scribed Mg AZ91D panels coated with: (a) chromate conversion coating, (b) chromate anodized coating, (c) the coating of the present invention and (d) chromate free anodized coating; before and after 168 hour (1 week) salt-fog exposure. The dry panels look exceptionally good (compared to other control panels) with only a few small pits with minimal hydroxide buildup. A change in color was observed in the case of the coating of the present invention from bright green to a dull gray. The protection offered by the coating of the present invention was excellent even after 1008 hours (6 weeks) in the salt-fog chamber and was comparable to that offered by the chromate free anodized coating (FIG. 7(*c*") and (*d*")).

Example 1

Demonstration of Corrosion Protection Offered by the Coating of the Present Invention 1.a Coating Morphology A coating formulation was prepared, which consisted of 256 g $Mg(NO_3)_2.6H_2O$, 62.5 g $Al(NO_3)_3.9H_2O$, and 8 g of $(NH4)_6V_{10}O_{28}.6H_2O$ dissolved in 1000 ml of DI water. The pH of the solution was approximately 2.8, due to the hydrolysis of $Al^{3+}$ and $Mg^{2+}$ ions. Magnesium AZ91D alloy panels were acid etched (pickled) using a mixture of 377 ml of Glycolic acid, 94.55 g of $NaNO_3$ in 1515.5 ml of DI water. AZ91D panels were acid etched for 3 minutes to clean and activate the surface. This formed a black deposit on the panels that could be wiped off easily. Subsequently, the cleaned panels were immersed in the coating bath for 10 minutes. The panels that were initially dull gray in color were coated with a bright yellow-green layer, approximately 2-3 μm thick as shown in FIG. 1.

1.b Corrosion Resistance Compared to Chromate Conversion Coating and Anodized Coating:

The conversion coating of the present invention exhibits less corrosion than the chromate and non-chromate industry standards for pretreatments. Treated only and pretreated/primed samples (liquid primer, powder coat and e-coat) were examined. Based on results for treated-only and pretreated/primed samples, the coating of the present invention is a self-healing conversion coating possessing equivalent or better properties than a chromate conversion coating. Additionally, based on results for treated-only samples, this new coating offers corrosion protection similar to a state-of-the-art chromate-free anodized coating. This is shown in FIG. 7.

1.c Demonstration of Self-Healing

Figure 8:
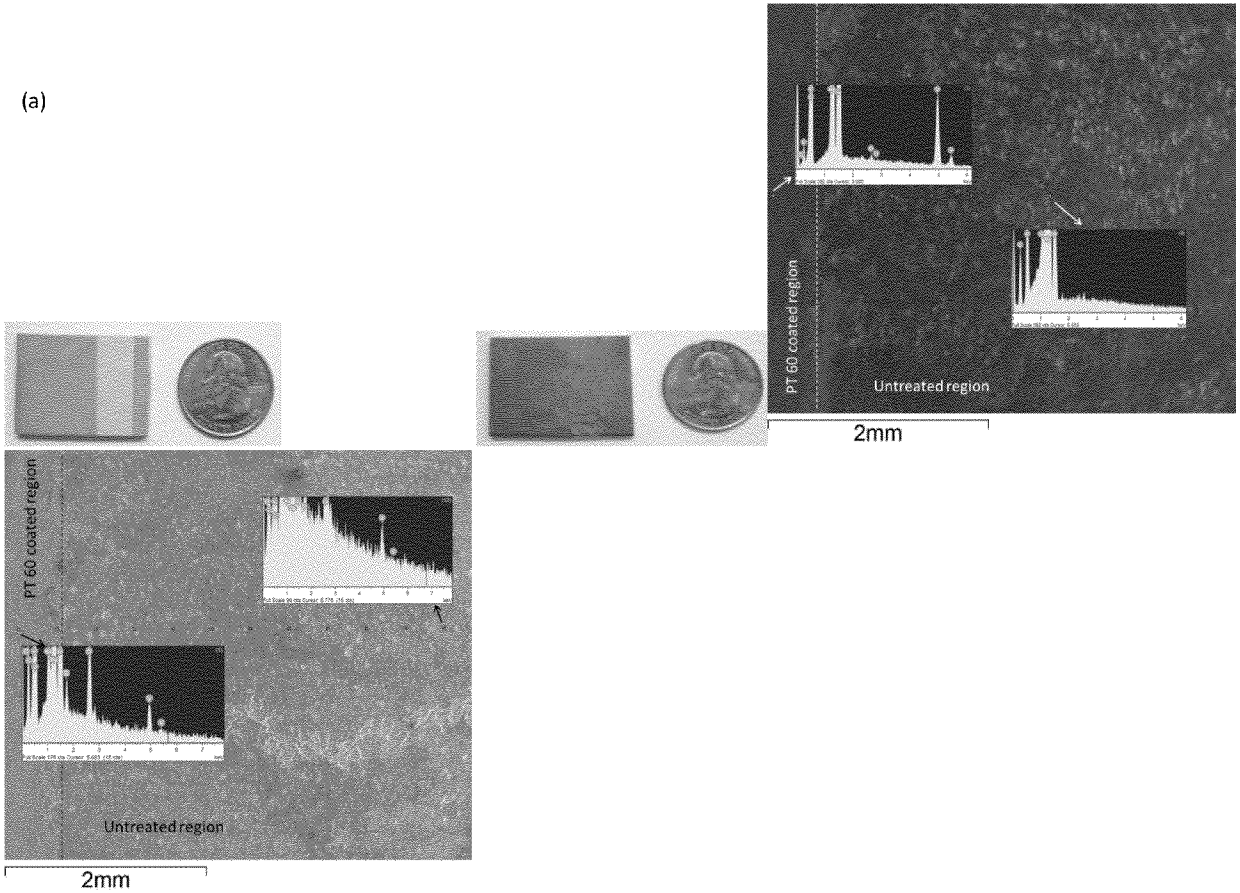
FIG. 8: Mg AZ91D alloy coated with the coating of the present invention, before and after 168 hours (1 week) of salt-fog exposure. An artificial defect was introduced in the coating to verify self-healing: (a) Coated sample before exposure, (b) Alloy piece after 168 hours of exposure to the salt-spray environment (ASTM B117).

In order to demonstrate self-healing via migration of Vanadium species to defect sites, magnesium alloy AZ91D panels were coated with the coating of the present invention and a strip of the alloy piece was left untreated as shown in FIG. 8(*a*). This was done to introduce an artificial "defect site". The coating was green in color, while the untreated region was silver-gray. SEM examination of the test pieces reveal that prior to exposing the samples to salt-fog environment, vanadium moieties (the self-healing component) were present only in the coated region as part of the coating system. It was found to be absent in the untreated region, which was expected (shown in the EDX spectra taken from both the regions). After 168 hours of exposure in the salt-fog chamber, it is evident that the coated region is still protected (no pitting observed in FIG. 8(*b*)). In addition, it is visible that the untreated region has also been protected by the migration and slow release of vanadium species to the defect site. This diffusion of vanadium was confirmed by the emergence of peaks in the EDX spectra corresponding to the presence of vanadium, in untreated regions, even about 2 mm away from the coated region. This data demonstrates that the coating of the present invention is a self-healing conversion coating. This active corrosion protection is instrumental in protecting the alloy for over 1000 hours in the salt-fog environment as shown in FIG. 7(*c*").

Example 2

The Need for Vanadate Ions for Imparting Self-Healing Properties

Figure 9:
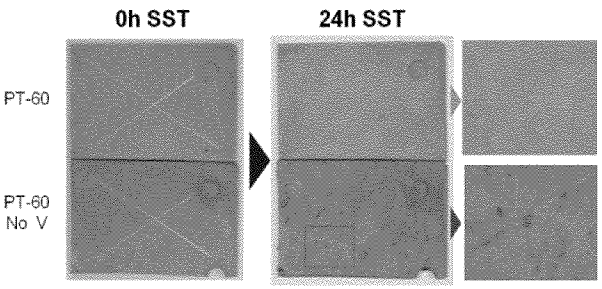
FIG. 9: Salt-spray testing (SST) images of (a) a scribed Mg AZ91D coupons (3"×2") with GNP (3 min)+the coating of the present invention (5 min) (yellow-green) and GNP (3 min)+a variant of the coating of the present invention (5 min) without the ammonium decavanadate added (gray) at 0 h SST and after 24 h SST. The former coated coupon shows no evidence of corrosion (green box) after 24 h salt-spray exposure, while corrosion pits (black spots) are seen in and around the scribe in case of the latter (red box). (b) Similar results were observed after extended SST.
Figure 9:
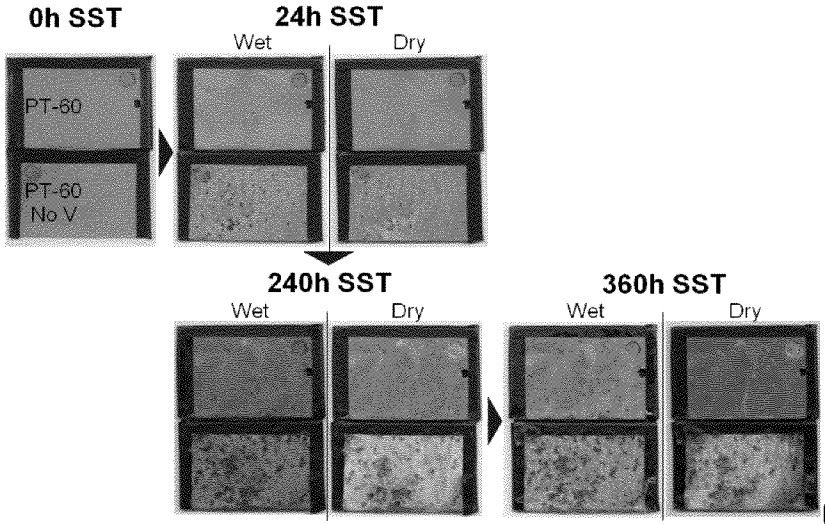

A coating experiment was conducted similar to that described Example 1, except that the conversion treatment bath contained only 256 g $Mg(NO_3)_2.6H_2O$ and 62.5 g $Al(NO_3)_3.9H_2O$ in 1000 ml of water, and did not contain ammonium decavanadate. The corrosion resistance offered by the resulting coating was better than the untreated AZ91D panels but it was much reduced as compared to when the ammonium decavanadate was present. Comparative salt-spray testing data is shown in FIG. 9.

Example 3

The Need for Aluminum Nitrate to Form the Hydroxoaluminate Backbone

A coating experiment was conducted similar to that described Example 1, except that the conversion treatment bath contained only 256 g of $Mg(NO_3)_2.6H_2O$ and 8 g of $(NH4)_6V_{10}O_{28}.6H_2O$ dissolved in 1000 ml of DI water, and did not contain $Al(NO_3)_3.9H_2O$. There was no conversion coating formed after immersion as the solution was not acidic enough to bind to the magnesium alloy.

Example 4

The Need of Magnesium Nitrate to Form the Magnesium Hydroxide Domains

Figure 10:
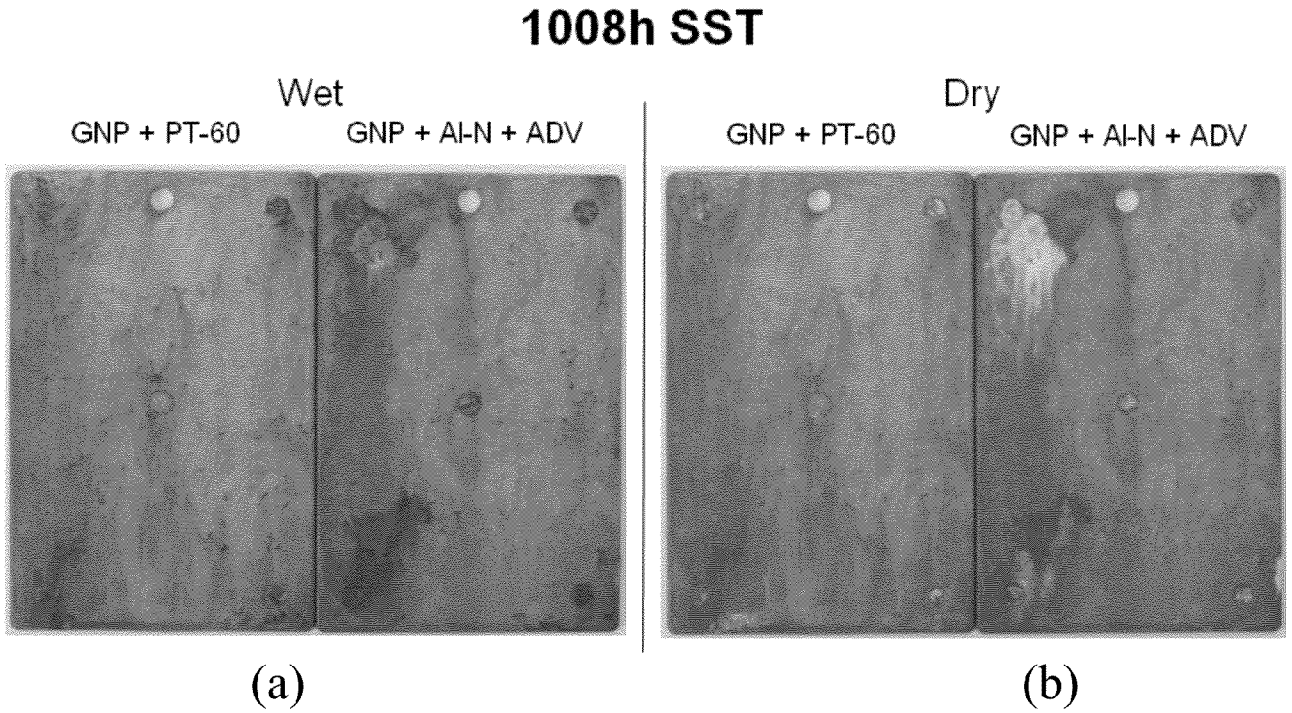
FIG. 10: Mg AZ91D (4"×3") panel after GNP treatment and coated with the coating of the present invention. A second panel was coated with a variant of the coating of the present invention without $Mg(NO_3)_2.6H_2O$. Both the panels have been shown in (a) wet and (b) dry condition after 1008 hours of salt spray testing (SST).

A coating experiment was conducted similar to that described Example 1, except that the conversion treatment bath contained only 62.5 g $Al(NO_3)_3.9H_2O$ and 8 g of $(NH4)_6V_{10}O_{28}.6H_2O$ dissolved in 1000 ml of DI water, and did not contain $Mg(NO_3)_2.6H_2O$. The corrosion resistance offered by the resulting coating was less compared to the present composition as shown in FIG. 10. After 1008 hours of salt-spray testing, the Mg AZ91D alloy panels coated with the present composition formulation showed a protected surface while the second panel where $Mg(NO_3)_2.6H_2O$ was not added, showed signs of coating failure.

Example 5

Figure 11:
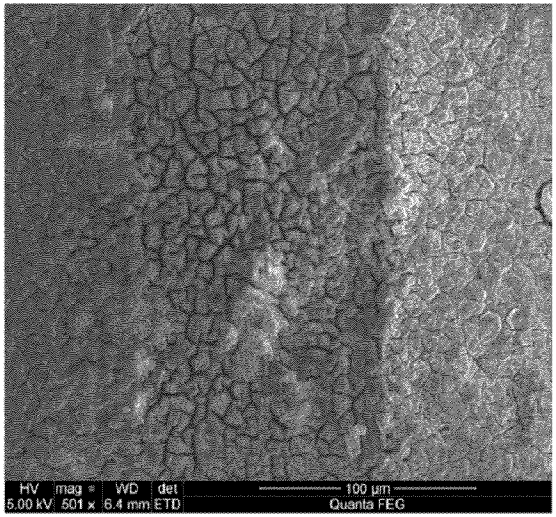
FIG. 11: SEM image (a) AZ91D alloy coated with the coating of the present invention, with a dip time of 30 minutes. A vertical scribe was made on the coated region—clean before exposure to salt solution. (b) AZ91D alloy coated with the coating of the present invention after 24 hours of exposure to 5 wt. % salt solution. (c) cross-section micrograph showing the thickness of the coating (approximately 10 microns)
Figure 11:
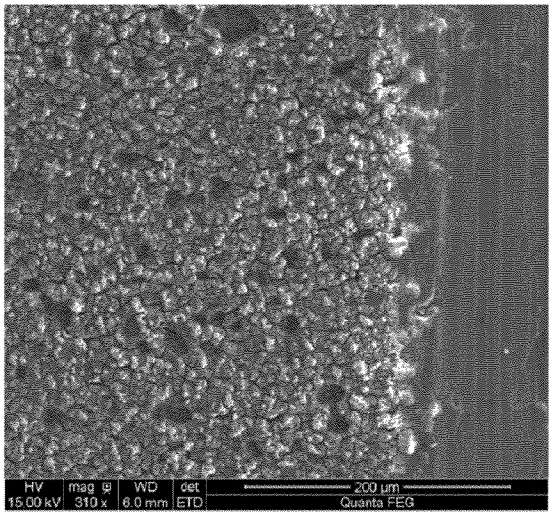
Figure 11:
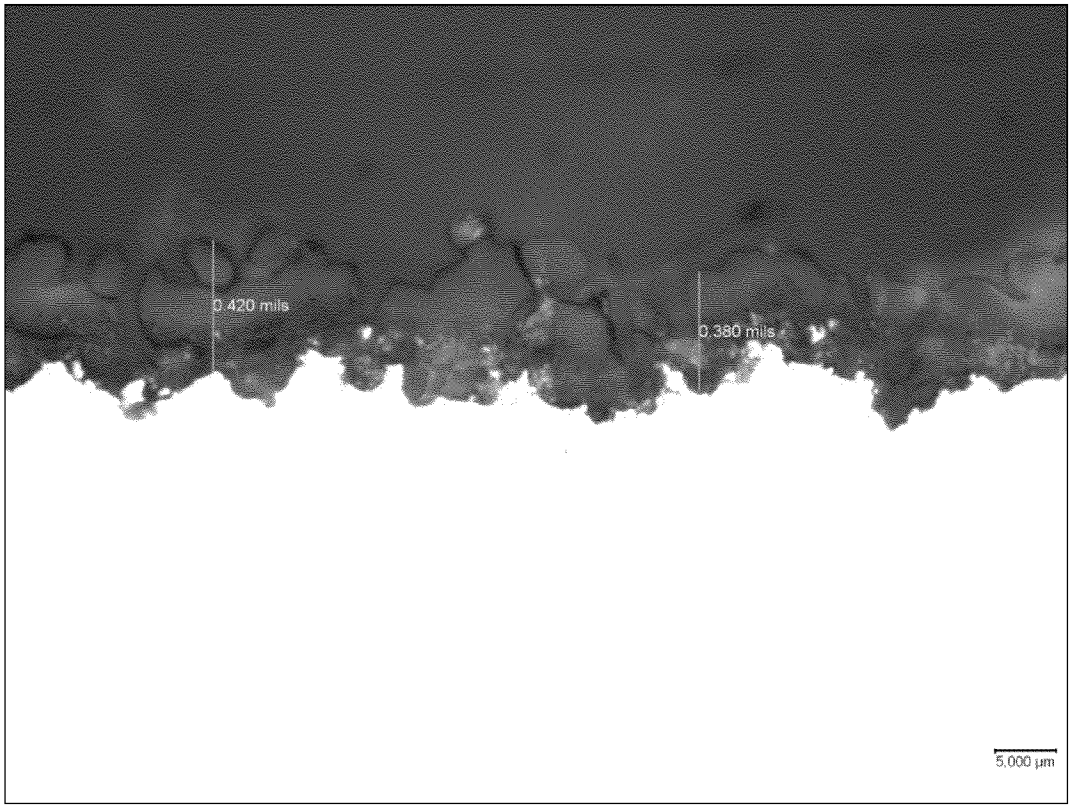

Demonstration of a Higher Degree of Self-Healing Offered by the Coating of the Present Invention with a Thicker Conversion Layer A coating experiment was conducted similar to that described in Example 1, except that the Mg AZ91D panels were dipped for 30 minutes instead of 10 minutes. This resulted in the formation of a thicker conversion coating as seen in FIG. 11(*c*). A scribe was made in the coated region to mimic a defect in the coating, FIG. 11(*a*). This sample was exposed to a 5% salt solution for 24 hours. Prior to the exposure, the scribed was clean with the alloy being exposed. After exposure to the corrosion salt solution, the scribe was covered with a cracked layer as shown in FIG. 11(*b*). EDX analysis showed that the scribe was coated with a vanadium compound suggesting migration from the coating to the cracked region.

Example 6

Depletion of the "Self-Healing" Ingredient in the Process of "Healing"

Figure 12:
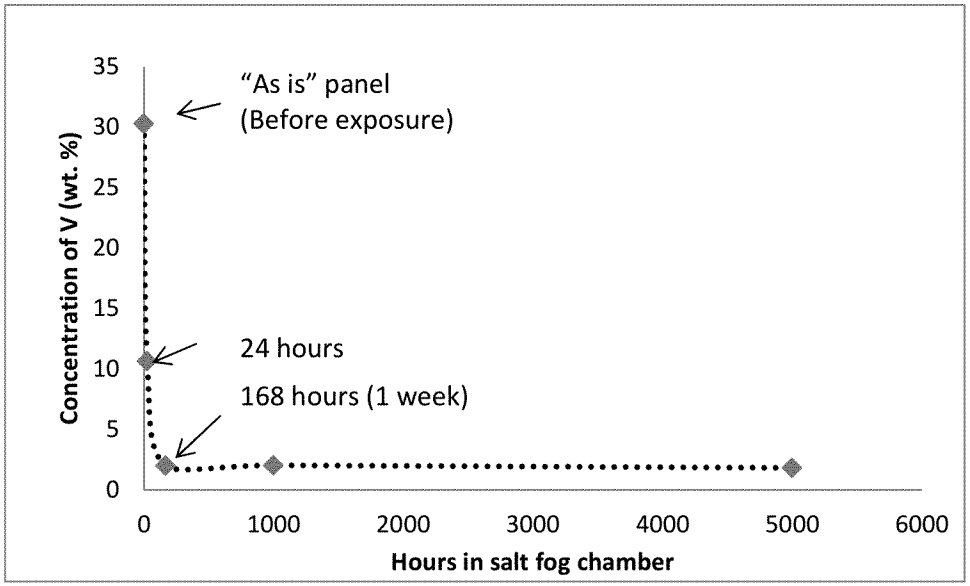
FIG. 12: Variation of surface concentration of vanadium (by weight) on a Mg AZ91D alloy coated with the coating of the present invention, after 5000 hours of exposure to salt spray testing (ASTM B117).

A coating experiment was conducted similar to that described in Example 1. The coated samples were subjected to salt-spray testing (ASTM B 117) for a period of 5000 hours. SEM/EDS analysis was carried out to monitor the surface Vanadium concentration (by weight) during the time of exposure. It was observed that the surface concentration of vanadium decreased from an initial value of ~30% to a final value of ~2% after 168 hours (1 week) of exposure. This is shown in FIG. 12. The final concentration of vanadium was enough to provide high corrosion resistance in the highly corrosive environment in the salt-fog chamber in excess of 5000 hours.

Hence, when a magnesium alloy is treated with the coating of the present invention, followed by a primer, the coating acts as a reservoir for vanadium which is the "self-healing" ingredient. As defects are inflicted on the coating, vanadium from the conversion layer is released to "heal" the defect. This phenomenon can occur multiple times, until the surface concentration of vanadium reaches a value ~2%.

As is well known, the formula parameters set forth herein are for example only, such parameters can be scaled and adjusted in accordance with the teachings of this invention. The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A non-chromate conversion coating for magnesium alloys comprising a mixture of domains of hydroxoaluminate, domains of magnesium hydroxide, and vanadium containing moieties encapsulated within the domains of the of hydroxoaluminate and magnesium hydroxide.

2. The conversion coating as claimed in claim 1 where the size of the domains is 5 to 50 nm.

3. The conversion coating as claimed in claim 1 wherein the concentration of vanadium containing moieties is greater than 2 weight % and less than 30 weight % of the solids.

4. The conversion coating as claimed in claim 1 wherein the magnesium alloy that is to be coated includes aluminum and the relative concentration of aluminum to magnesium in the conversion coating is higher than that in the magnesium alloy to be coated.

5. The conversion coating as claimed in claim 1 wherein the thickness of the conversion coating is less than 100 microns.

6. The conversion coating as claimed in claim 1 wherein the thickness of the conversion coating is 1 to 10 microns.

* * * * *